United States Patent [19]

Johnson

[11] 4,384,558

[45] May 24, 1983

[54] ENGINE COMPRESSION BRAKE EMPLOYING AUTOMATIC LASH ADJUSTMENT

[75] Inventor: Kelly A. Johnson, Columbus, Ind.

[73] Assignee: Cummins Engine Company, Inc., Columbus, Ind.

[21] Appl. No.: 289,693

[22] Filed: Aug. 3, 1981

[51] Int. Cl.[3] ..... F02D 31/00

[52] U.S. Cl. ..... 123/321; 123/90.15

[58] Field of Search ..... 123/320, 321, 90.12, 123/90.15, 90.43, 90.45, 90.46, 198 F, 322

[56] References Cited

U.S. PATENT DOCUMENTS

| | | | |
|---|---|---|---|
| 3,220,392 | 11/1965 | Cummins | 123/321 |
| 3,405,699 | 10/1968 | Laas | 123/320 |
| 3,786,792 | 1/1974 | Pelizzoni | 123/90.16 |
| 3,859,970 | 1/1975 | Dreisin | 123/320 |
| 4,150,640 | 4/1979 | Egan | 123/90.12 |
| 4,271,796 | 6/1981 | Sickler et al. | 123/321 |

*Primary Examiner*—William A. Cuchlinski, Jr.
*Attorney, Agent, or Firm*—Sixbey, Friedman & Leedom

[57] ABSTRACT

A master/slave hydraulic braking system for an internal combustion engine is disclosed for converting an engine from a power mode operation to a braking mode operation. A slave piston (12) operates in one of three positions including a fully retracted position in which one end thereof is spaced from the associated exhaust valve structure (2,4,8) by at least a predetermined lash sufficient to prevent contact between the actuating piston (12) and the valve structure (2,4,8) at all times during the power mode of engine operation, a brake actuated position in which the piston (12) is advanced sufficiently to open the exhaust valve (2,4) during the braking mode of engine operation and a brake ready position in which the piston (12) is advanced only far enough to take up the actual lash between the piston (12) and the associated exhaust valve structure (2,4,8) at all times during braking mode operation of the engine except when the actuating piston (12) is being advanced to open the exhaust valves (2,4). The disclosed system includes a lash take up means (58) including a biasing means (60) formed from a base support (62) attached to the actuating piston housing (16), an intermediate support (68) positioned between the base support (62) and one portion of the actuating piston (12), a first compression spring (70) extending between the intermediate support (68) and one portion of the actuating piston (12) for imparting a biasing force to the actuating piston (12) which tends to move the piston (12) from the brake ready position to the retracted position and a second compression spring (66) extending between the base support (62) and the intermediate support (68) for imparting to the piston (12) a biasing force which tends to move the piston from the brake actuated position to the brake ready position. First and second stop means (74 and 76) are arranged to provide for a selective adjustment of the fully retracted and brake ready positions of the actuating piston (12).

11 Claims, 3 Drawing Figures

FLUID CONTROL MEANS 18
53
50
48
46
52
30
14
12
16
6
54
9
4
10
2
8
56
58
60
55
40
34
32
31
42
44
38
36
24
20
28
26
22

ENGINE COMPRESSION BRAKE EMPLOYING AUTOMATIC LASH ADJUSTMENT

DESCRIPTION

1. Technical Field

This invention relates to a slave/master hydraulic braking system for altering the normal timing of exhaust valve opening in an internal combustion engine in order to operate the engine in a braking mode.

2. Background Art

For many internal combustion engine applications, such as for powering heavy over-the-road trucks, it is highly desirable at times to operate the engine in a braking mode. This capability can substantially reduce the original cost, complexity and maintenance expense associated with standard friction brakes to say nothing of the added safety factor in having a back-up brake system. One well known approach has been to convert the engine into a compressor by cutting off fuel flow and, opening the exhaust valve for each cylinder near the end of the compression stroke and to close the exhaust valve shortly thereafter; thus, permitting the conversion of the kinetic inertial energy of the vehicle into compressed gas energy which may be released to atmosphere when the exhaust valves are partially opened.

To operate an engine reliably as a compressor, rather exacting control is necessary over the timed relationship of exhaust valve opening and closing relative to the movement of the associated piston. The desired exacting control may be achieved by such elaborate techniques as providing a dual ramp cam and cooperating, hydraulically operated tappet to selectively open and close the exhaust valve as necessary to operate the engine as a gas compressor such as illustrated in U.S. Pat. No. 3,786,792 to Pelizzoni et al.

However, systems which require specially designed cams can add significantly to the original cost of engine manufacture and can make retrofitting impractical. A less expensive approach has been to provide a slave hydraulic piston for opening an exhaust valve near the end of the compression stroke of an engine piston with which the exhaust valve is associated. The slave piston which opens the exhaust valve is actuated by a master piston hydraulically linked to the slave piston and mechanically actuated by an engine element which is displaced periodically in timed relationship with the compression stroke of the engine piston. One such engine element may be the intake valve train of another cylinder timed to open shortly before the first engine cylinder piston reaches the top dead center of its compression stroke. Other engine operating elements may be used to actuate the master piston of the braking system so long as the actuation of the master piston occurs at the proper moment near the end of the compression stroke of the piston whose associated exhaust valve is to be actuated by the slave piston. For example, certain types of compression ignition engines are equipped with fuel injector actuating mechanisms which are mechanically actuated near the end of the compression stroke of the engine piston with which the fuel injector valve train is associated thus providing an actuating mechanism immediately adjacent the valve which is to be opened all as illustrated in U.S. Pat. No. 3,220,932 to Cummins and as further described in U.S. Pat. No. 3,405,699 to Laas and 4,150,640 to Egan.

The optimum time for initiating exhaust valve opening to achieve compression braking in an engine having a cam operated fuel injector is related, for example, to the mechanism used for opening, the speed of opening and the total degree of opening achieved and is unrelated to the ideal timing for fuel injector operation. In many engines, especially engines which rely on carefully controlled fuel injection timing to meet pollution control standards, the time at which the fuel injector train is initially moved by the engine cam is somewhat later than the ideal time for initiating exhaust valve opening to achieve maximum braking effect from release of compressed gas. When a master/slave hydraulic system such as disclosed in U.S. Pat. No. 3,405,699 is used, a nominal clearance or lash (0.013 to 0.014 inches) must be provided between the slave piston and the exhaust valve cross head to accommodate thermal growth of the exhaust valve structure during full load/-high temperature operation of the engine. The time required for closing the lash between the slave piston and the exhaust valve cross head introduces an additional undesirable delay in the initiation of exhaust valve opening during braking mode operation of the engine. Yet another disadvantage of having to close the slave piston lash is that significant mechanical loads are imparted to the exhaust valve structure when the slave piston is forced at accelerating speed across the lash distance by fluid actuating pressure and the slave piston impacts with the exhaust valve cross head. Prior to the subject invention, no satisfactory solution had been found to the conflicting demands for more nearly optimal exhaust valve opening and low mechanical loading in a master/slave hydraulic braking system while simultaneously providing the necessary thermal growth accommodating lash between the slave piston and the exhaust valve structure.

Disclosure of Invention

It is a primary object of this invention to overcome the deficiencies of the prior art as noted above by providing a master/slave hydraulic braking system for an internal combustion engine which is capable of accommodating thermal growth in the exhaust valve structure and at the same time is capable of avoiding exhaust valve opening delay and high mechanical loading due to lash between the slave piston and the exhaust valve structure.

Another object of this invention is to provide a master/slave hydraulic braking system for an internal combustion engine in which a predetermined lash is provided between the slave piston and the exhaust valve structure which is sufficient at all times during the power mode of engine operation to prevent contact between the slave piston and the exhaust valve structure and in which a lash take-up means is provided for moving the slave piston toward the valve structure by an amount sufficient to eliminate the lash at all times during braking mode operation of the engine.

A more specific object of this invention is to provide a lash take-up means for use in a master/slave hydraulic braking system for an internal combustion engine including a slave piston housing, a base support attached to the housing, an intermediate support positioned between the base support and one portion of the slave piston, a first compression spring extending between the intermediate support and one portion of the slave piston for imparting a biasing force to the piston which tends to move the piston from the brake ready position to the retracted position and a second compression spring extending between the base support and the intermediate support for imparting to the piston a biasing force which tends to return the piston from the brake actuated position to the brake ready position.

Another object of this invention is to provide a master/slave hydraulic braking system including a fluid control means for charging the hydraulic system at a pressure which is sufficient to overcome the biasing force imparted to the slave piston by the first compression spring but insufficient to overcome the biasing force imparted to the slave piston by the second compression spring whereby the slave piston is moved to the brake ready position whenever the hydraulic system is charged with fluid.

Yet another more specific object of the subject invention is to provide a master/slave hydraulic braking system for an internal combustion engine of the above type further including a first stop means for adjusting the lash between the slave piston and the exhaust valve structure and a second stop means for adjusting the distance between the retracted position and the brake ready position.

Other important advantages and objects of the invention will become apparent from a consideration of the following Brief Description of the Drawings and the Best Mode for Carrying Out the Invention.

BEST MODE FOR CARRYING OUT THE INVENTION

Figure 1:
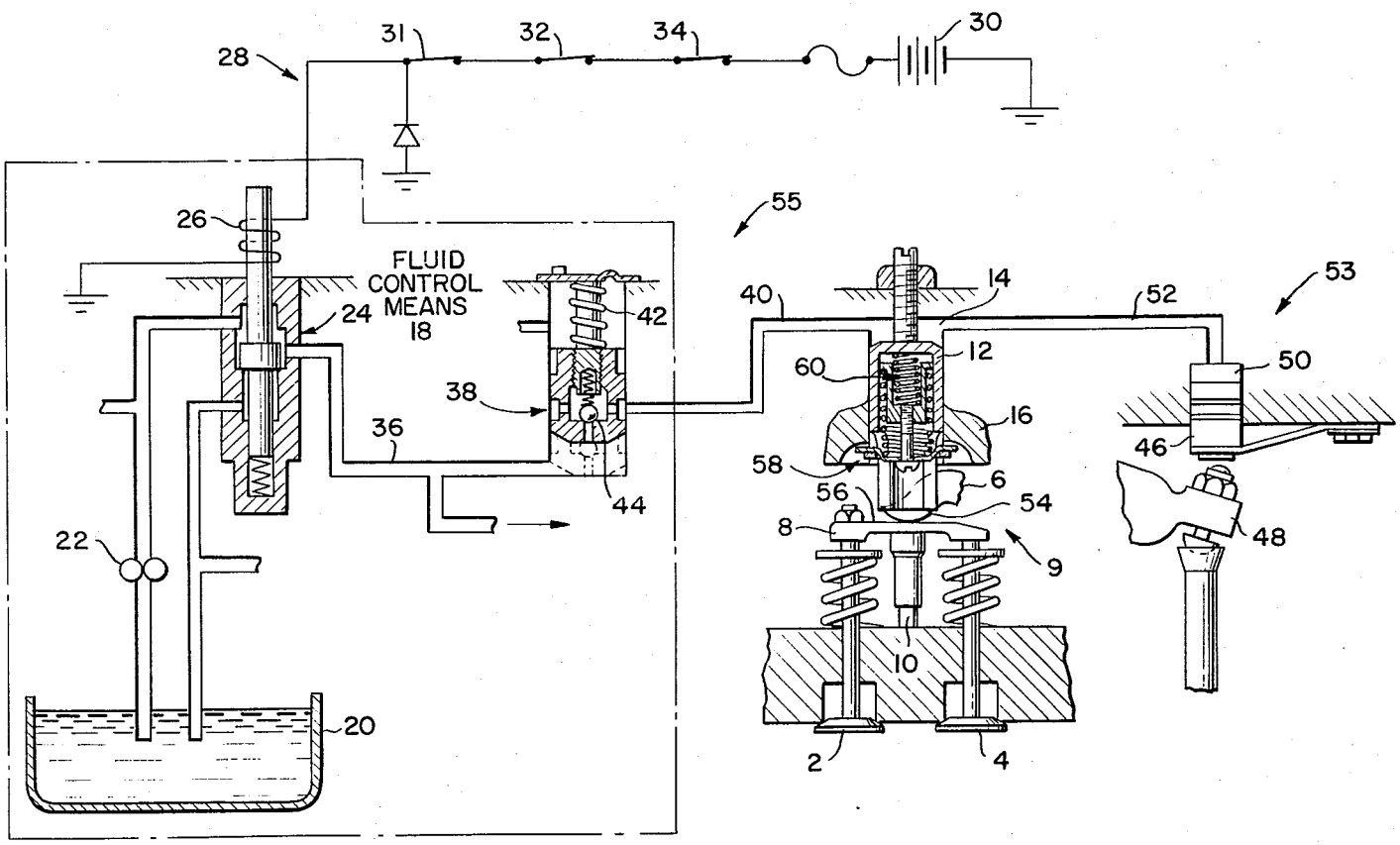
FIG. 1 is a diagrammatic illustration of an electrically and fluidically controlled master/slave braking system for a fluid injected internal combustion engine designed in accordance with the subject invention.

FIG. 1 discloses a specific embodiment of the subject invention as employed in a compressed gas release braking system for an internal combustion engine equipped with a cam operated fluid injector train whereby the engine may be converted from a power mode of operation to a braking mode in a manner to achieve optimum timing of the exhaust valve opening without imparting excessive mechanical loads on the exhaust valve structure. In particular, the system of FIG. 1 discloses a compressed gas release braking system such as disclosed in U.S. Pat. Nos. 3,405,699 and 4,150,640 including a pair of exhaust valves 2 and 4 associated with a single engine piston (not illustrated) for simultaneous operation by an exhaust rocker lever 6 during the normal power mode of engine operation. In such a power mode, the exhuast rocker lever 6 is operated through a valve train including a rotating cam (not illustrated) which is designed to normally leave the exhaust valves closed during the compression and expansion strokes of the associated piston. However, as explained in U.S. Pat. Nos. 3,405,699 and 3,220,392, it is necessary to open at least partially the exhaust valves near the end of the compression stroke of the associated piston if it is desired to the engine as a compressor for braking purposes. Rocker lever 6 engages the exhaust valve structure including valves 2 and 4 and a crosshead tee 8 which is designed to reciprocate on a support 10 during the normal power mode of engine operation under the sole control of rocker lever 6.

Thus the rocker lever 6 and crosshead tee 8 may be considered a power mode operating means 9 for cyclically opening the exhaust valve in a first predetermined timed relationship with the movement of the combustion engine piston to cause the engine to operate in a power mode.

When it is desired to operate the engine in a braking mode, it is necessary to open at least partially the exhaust valves near the end of the compression stroke of the associated piston. As illustrated in FIG. 1, this may be accomplished by providing an actuating piston 12 (which may also be referred to as a slave piston) adapted to reciprocate within a fluid cavity 14 contained in a housing 16, only partially illustrated in FIG. 1. Actuating piston 12 is normally biased toward the retracted position illustrated in FIG. 1 by a compression spring arrangement which will be described in greater detail hereinbelow and may be advanced toward a brake actuated position under fluid pressure supplied to cavity 14.

In order to provide the necessary fluid to cavity 14, a fluid control means 18 is provided for charging cavity 14 with fluid at a pressure which is insufficient to cause the piston 12 to move to its brake actuating position. For a detailed description of the operation of the fluid control means 18, reference is made to U.S. Pat. No. 4,150,640. In summary form, however, fluid control means 18 includes a sump of non-compressible fluid such as the engine lubricating oil, a fluid pump 22 which may be the lubrication oil pump for the engine. The compressible fluid under relatively low pressure supplied by pump 22 may be directed either to the fluid cavity 14 or returned to sump 20 by means of a solenoid controlled three-way valve 24. In FIG. 1, three-way valve 24 is shown to be operated in response to an electrical signal supplied to solenoid 26 by an electrical control circuit 28 consisting primarily of a series connection of three separate switches between solenoid 26 and a pwer supply 30 such as a battery. In particular, electrical control circuit 28 may include a fuel pump switch 31 which closes only when the engine fuel pump is returned to its idle position. A clutch switch 32 may be provided so that the engine may only be operated in the braking mode when the clutch is engaged, thereby insuring that the braking effect of the engine is transferred to the vehicle wheels. Yet another type of switch may be of the type illustrated by switch 34 which is mounted for actuation by a vehicle operator which allows the operator to activate or deactivate the system as he desires.

When all of the switches 31, 32 and 34 are closed, solenoid 26 will be energized to place the three-way valve 24 in the position illustrated in FIG. 1. Upon opening of any one of the three switches, valve 24 will assume a condition in which the fluid supplied by pump 22 is returned directly to sump 20 and the supply passage 36 is also connected to sump 20 to remove all fluid pressure from the system and thereby allow piston 12 to return to its fully retracted position. In order to permit the fluid supplied to cavity 14 to be placed under very high pressure, a dual function slide valve 38 is included in flow passage 36 and is movable between a charging position (illustrated in slotted lines in FIG. 1) in which non-compressible fluid may flow into the fluid cavity 14 through fluid passage 40 and a venting position (illustrated in dashed lines) in which the fluid is blocked from flow into the fluid contact and the non-compressible fluid within cavity 14 is vented. Slide valve 38 is normally biased to the venting position by spring 42. However, the bias of spring 42 is insufficient to hold the dual function of slide valve 42 in the venting position when fluid from the pump 22 is passed into passage 36 by valve 24. A check valve 44 is provided in slide valve 38 to permit fluid to flow into passage 40 when the slide valve is in the position illustrated in FIG. 1 while at the same time preventing the reverse flow.

To effect the desired cyclic operation of the exhaust valves during the braking mode of operation, a master piston 46 is mounted for reciprocal movement in response to actuation by a portion of the fuel injector actuating train 48 (only partially illustrated). Piston 46 is received within a cavity 50 which communicates with the fluid cavity 14 through passage 52 and is charged by the fluid control means 18 in the same manner as cavity 14. Upon upward movement of the injector train portion 48 illustrated in FIG. 1, piston 46 is also moved upwardly to place non-compressible fluid in cavities 50 and 14 under very high pressure to thereby force piston 12 downwardly into engagement crosshead tee 8 and effect opening of valves 2 and 4. Thus, master piston 46 and cavity 50 form a pressurizing means 53 for cyclically increasing the pressure of fluid within fluid cavity 14 to a level which is sufficient to overcome, periodically, the biasing force against piston 12 to cause piston 12 to apply sufficient pressure to crosshead tee 8 to open the exhaust valves. It can further be seen that electrical control circuit 28, fluid control means 18 and the master piston 46 together with passages 40 and 52 and piston 12 form a braking mode operating means 55 for cyclically opening the exhaust valve in a predetermined timed relationship with the movement of the combustion engine piston to cause the engine to operate in a braking mode by cyclically displacing valve opening surface 56 to release compressed gas pressure from the engine cylinder.

As illustrated in FIG. 1, actuating piston 12 has a force applying surface 54 formed at one end thereof normally in spaced relationship to a valve opening surface 56 formed on crosshead tee 8. FIG. 1 illustrates in exaggerated form the normal nominal clearance between surfaces 54 and 56 which can be referred to as the lash between piston 12 and crosshead tee 8. A clearance must be great enough to prevent actual contact between the crosshead tee 8 at all times during the power mode operation of the engine. Under full load, the exhaust valve structure illustrated in FIG. 1 will increase in temperature and will thus experience thermal growth relative to actuating piston 12. To accommodate this situation, a lash between surfaces 54 and 56 of 0.013 to 0.014 inches is required to thereby insure that the exhaust valves may always return to a fully closed position. While the existence of this lash during the power mode operation is positively essential to proper engine operation, the lash between surfaces 54 and 56 becomes detrimental to optimal braking mode operation. In particular, lash introduces an undesirable delay between the initiation of movement by injector train portion 48 in the beginning of exhaust valve opening and the initiation of opening movement of valves 2 and 4. Moreover, the existence of the lash permits actuating piston 12 to accelerate under the sudden high fluid pressure created by upward movement of master piston 46 thus subjecting crosshead tee 8 and the related exhaust valve structure to high mechanical loads upon impact.

In order to provide the normally necessary return bias which tends to return piston 12 to its fully retracted position, and at the same time eliminate the negative effects of lash during the braking mode of operation, a lash take-up means 58 is provided for allowing piston 12 to be displaced to take up the lash between surfaces 54 and 56 in which position piston 12 resides at all times during braking mode operation of the engine except when the piston is advanced further to cause valves 2 and 4 to open to release compressed gas pressure. As will be described in greater detail with reference to FIGS. 2 and 3, the lash take up means 58 includes biasing means 60 for continuously applying no more than a first predetermined biasing force to piston 12 to tend to move force applying surface 54 from a brake ready position in which there is zero lash to a fully retracted position (illustrated in FIG. 1) and for applying at least a second predetermined biasing force substantially greater than the first predetermined force to tend to return surface 54 from the brake actuated position in which valves 2 and 4 are opened during braking operation back to the brake ready position.

Figures 2, 3:
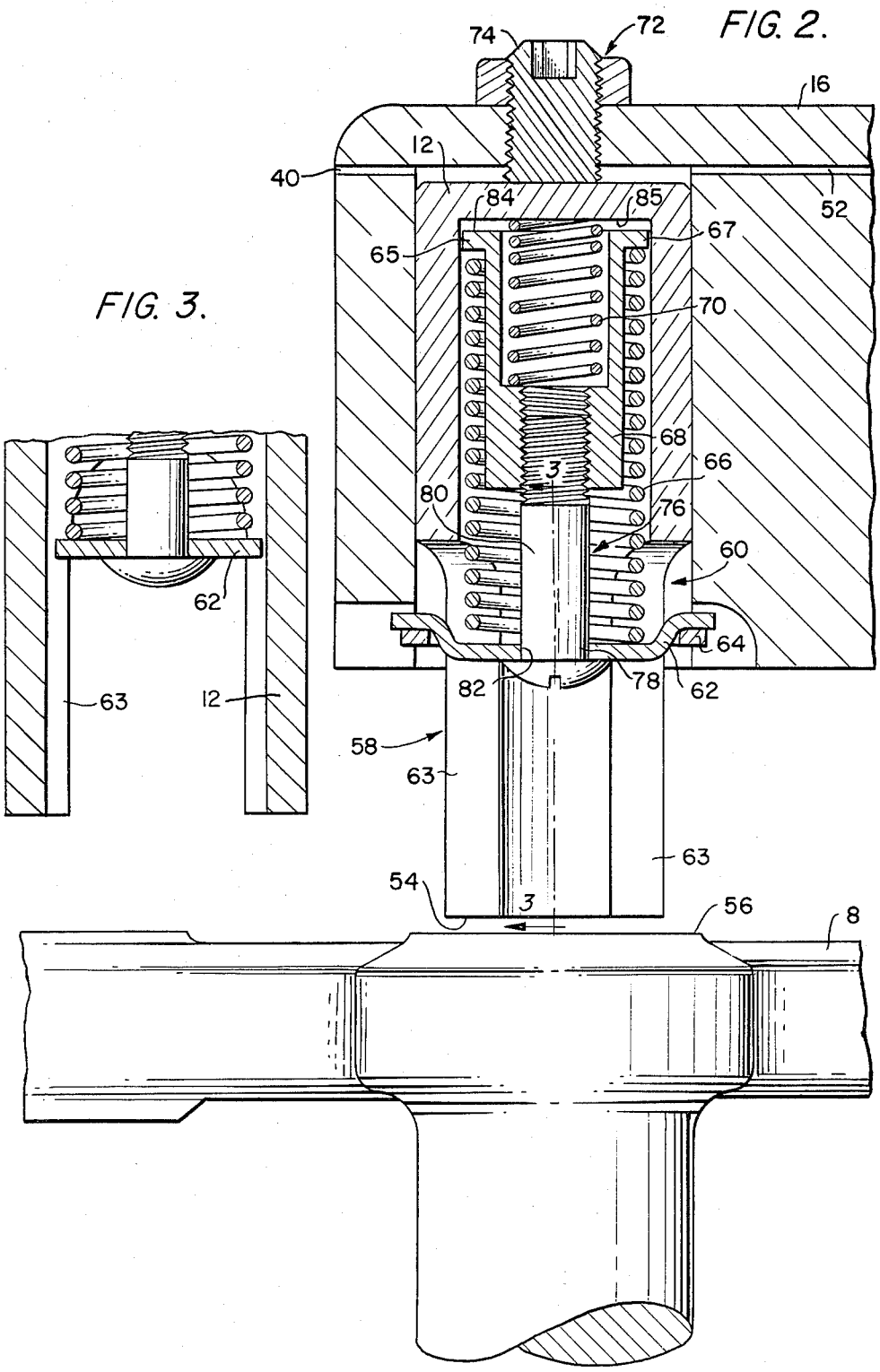
FIG. 2 is a broken away cross-sectional view of a slave/piston and lash take-up means shown in FIG. 1 taken along lines 2—2.
FIG. 3 is a cross-sectional view of one portion of the slave piston illustrated in FIG. 2 taken along lines 3—3.

For a more detailed understanding of the operation of the lash take-up means 58, reference is now made to FIG. 2 wherein it can be seen that biasing means 60 includes a base support 62 attached fixedly to housing 16 by means of a snap ring 64. Actuating piston 14 is formed of a generally inverted cup-shaped configuration in which the rim thereof forms the force applying surface 54 and the interior is shaped to receive biasing means 60. As is also clear from FIG. 2, base support 62 extends transversely to the longitudinal axis of actuating piston 12 with the ends thereof extending through a pair of diametrically opposed longitudinal slots 63 formed in the side wall of actuating piston 12. The center portion of base support 62 thus forms a fixed support for a compression spring 66, one end of which engages base support 62 and the other end of which engages the outwardly extending flange 65 formed adjacent the rim of an upright cup-shaped intermediate support 68. Within the interior of intermediate support 68, another compression spring 70 is positioned to extend between the intermediate support and the upper wall portion of inverted cup-shaped actuating piston 12.

A first adjusting means 72 (which may be referred to as a first stop means) includes a screw threaded stop 74 received in a threaded opening at one end of housing 16. First adjusting means 72 determines the fully retracted position of actuating piston 12 to thereby set the nominal clearance of lash between surfaces 54 and 56. A second adjusting means 76 (which may be referred to as a second stop means) is provided for adjustably setting the maximum separation distance between base support 62 and intermediate support 68. In particular, second stop means 76 includes a threaded bolt-like element 78 having a shank portion 80 slidably received in a central aperture 82 formed in base support 62. The upper end of bolt-like element 78 is threadedly received in a threaded central aperture formed in intermediate support 68 such that rotational movement of bolt-like element 78 relative to intermediate support 68 will have the effect of changing the maximum possible distance between supports 62 and 68 and thereby places a predetermined pre-compression force on compression spring 66. The upper end of the rim of intermediate support 68 has a stop surface 84 formed thereon for engaging the upper wall portion of actuating piston 12. By selecting a relatively weak compression spring 70, the maximum biasing force imparted thereby to piston 12 can be selected to be less than the total fluid pressure imparted to piston 12 by virtue of the initial actuation of solenoid 26 to charge cavity 14 with non-compressible fluid applied by fluid control means 18.

Compression spring 66 is selected to be significantly stiffer than spring 70 and thus imparts a biasing force against intermediate support 68 which is in excess of the total pressure applied to piston 12 by pump 22. It is thus easy to see that surface 84 formed on the upper rim of intermediate support 68 operates normally to arrest downward movement of piston 12 upon initial charging of cavity 14 with non-compressible fluid from the fluid control means 18. By properly adjusting the distance between surface 84 and the upper inside wall 85 of piston 12 to equal the nominal lash between surfaces 54 and 56, the distance between the forward retracted position of surface 54 and the advanced brake ready position of surface 54 can be made to equal substantially the normal lash distance established by first stop means 72. Alternatively, second stop means 76 may be adjusted to cause the distance between surface 84 and the upper wall 85 to be either greater than or less than the nominal lash. If the distance between surface 84 and wall 85 is adjusted to be greater than the lash, piston 12 will first advance upon initial charging of cavity 14 by a sufficient amount to take up the existing lash. However, upon complete opening of the exhaust valves by the exhaust valve actuating train (not illustrated), piston 12 will advance to completely close the distance between surface 84 and wall 85. Thus, the first cycle of braking mode operation of the lash take-up means 58 will close the lash between surfaces 54 and 56 but will not cause surface 84 and wall 85 to contact. The second full cycle of braking mode operation will, however, completely close the distance between surfaces 84 and wall 85.

In some applications, it is necessary to limit the total braking horsepower of an engine during the braking mode of operation. In such circumstances, second stop means 76 can be adjusted as discussed above to cause the space between surface 84 and upper wall 85 to be greater than the nominal lash by an amount which will insure that the corresponding exhaust valves of the engine are held open (after the second cycle of brake operation) by an amount that will limit, to the degree desired, the total available braking horsepower of the engine. Obviously, when the valve structure including crosshead tee 8 experience substantial thermal growth, the actual brake ready position assumed by surface 54 may be less than the total nominal clearance assumed by surfaces 54 and 56 when the engine is cooler even though the nominal distances between surface 84 and wall 85 was initially adjusted to be equal to the lash. During this higher temperature operation, the lash take-up mechanism will operate in the same manner as described above with regard to the second stop means being adjusted to cause the distance between surface 84 and 85 to be greater than the initial distance between surfaces 54 and 56.

FIG. 3 merely discloses an additional cross-sectional view of the lower end of actuating piston 12 and base support 62 wherein it can be seen that the central portion of base support 62 is somewhat wider than the pair of opposed longitudinal slots 63. Obviously, the latter width of support 62 is reduced at its ends so as to clear the width of the longitudinal slots 63.

INDUSTRIAL APPLICABILITY

The disclosed system for eliminating the adverse consequences of lash in a master/slave hydraulic braking system for an internal combustion engine finds particular utility in heavy duty engines such as compression ignition engines used on highway vehicles. The subject invention would find additional application wherever lash or clearance is required between a force applying surface and a force receiving surface during normal operation but where no lash or clearance is desirable between the surfaces during a second mode of operation.

I claim:

1. A braking system for an internal combustion engine having a gas compressing combustion engine piston reciprocally mounted within an engine cylinder from which gas may be opening an exhaust valve, comprising (a) a power mode operating means for cyclically opening the exhaust valve in a first predetermined timed relation with the movement of the combustion engine piston to cause the engine to operate in a power mode, said power mode operating means including a valve opening surface which may be displaced upon application of a predetermined force to open the exhaust valve; and (b) braking mode operating means for cyclically opening the exhaust valve in a second predetermined timed relation with the movement of the combustion engine piston to cause the engine to operate in a braking mode by cyclically displacing said valve opening surface to release compressed gas pressure from the engine cylinder, said braking mode operating means including an actuating member having a force applying surface which moves between a retracted position in which said force applying surface is spaced from said valve opening surface by at least a predetermined lash sufficient to prevent contact between said surfaces at all times during the power mode of engine operation and a brake actuated position in which said force applying surface is advanced sufficiently to open the exhaust valve during the braking mode of engine operation, said braking mode operating means including a lash take up means for displacing said actuating member toward said valve opening surface to take up the lash between said force applying surface and said valve opening surface only during the braking mode of operation of the engine to define a brake ready position in which said force applying surface resides at all times during braking mode operation of the engine except when the force applying surface is being advanced further from said brake ready position toward said brake actuated position.

2. A braking system for an internal combustion engine having a gas compressing combustion engine piston reciprocally mounted within an engine cylinder from which gas may be exhausted by opening an exhaust valve, comprising (a) a power mode operating means for cyclically opening the exhaust valve in a first predetermined timed relation with the movement of the combustion engine piston to cause the engine to operate in a power mode, said power mode operating means including a valve opening surface which may be displaced upon application of a predetermined force to open the exhaust valve; and (b) braking mode operating means for cyclically opening the exhaust valve in a second predetermined timed relation with the movement of the combustion engine piston to cause the engine to operate in a braking mode by cyclically displacing said valve opening surface to release compressed gas pressure from the engine cylinder, said braking mode operating means including an actuating member having a force applying surface which moves between a retracted position in which said force applying surface is spaced from said valve opening surface by at least a predetermined lash sufficient to prevent contact between said surfaces at all times during the power mode of engine operation and a brake actuated position in which said force applying surface is advanced sufficiently to open the exhaust valve during the braking mode of engine operation, said braking mode operating means including a lash take up means for displacing said actuating member to take up the lash between said force applying surface and said valve opening surface to define a brake ready position in which said force applying surface resides at all times during braking mode operation of the engine except when the force applying surface is being advanced toward said brake actuated position, wherein said actuating member is an actuating piston and wherein said braking mode operating means further includes a housing containing a fluid cavity, said actuating piston being mounted for reciprocating movement within said fluid cavity, said actuating piston including said force applying surface at one end thereof, and said lash take up means includes biasing means for continuously applying no more than a first predetermined biasing force to said actuating piston to tend to move said force applying surface from said brake ready position to said retracted position and for applying at least a second predetermined biasing force substantially greater than said first predetermined force to tend to return said force applying surface from said brake actuated position toward said brake ready position.

3. A braking system as defined in claim 2, wherein said braking mode operating means includes (1) fluid control means for charging said fluid cavity with fluid at a pressure which is sufficient to overcome said first predetermined biasing force on said actuating piston to move said force applying surface from said retracted position to said brake ready position but which is insufficient to overcome said second predetermined biasing force.

4. A braking system as defined in claim 3, wherein said braking mode operating means further includes pressurizing means for cyclically increasing the pressure of fluid within said fluid cavity to a level which is sufficient to overcome periodically said second predetermined biasing force on said actuating piston to cause said force applying surface to move reciprocally between said brake ready position and said brake actuated position.

5. A braking system as defined in claim 4 for use on an internal combustion engine having a fuel injector train mechanically actuated near the end of each gas compressing stroke of the combustion engine piston, wherein said pressurizing means is mechanically actuated by the fuel injector train whenever the engine is operated in the braking mode.

6. A braking system as defined in claim 2, wherein said biasing means includes (1) a base support attached to said housing, (2) an intermediate support positioned between said base support and one portion of said actuating piston, (3) a first compression spring extending between said intermediate support and said one portion of said actuating piston for imparting a biasing force to said actuating piston which tends to move said force applying surface from said brake ready position to said retracted position, and (4) a second compression spring extending between said base support and said intermediate support for imparting to said actuating piston a biasing force which tends to move said force applying surface from said brake actuated position to said brake ready position.

7. A braking system as defined in claim 6, wherein said braking mode operating means further includes a first stop means for adjustably setting the retracted position of said actuating piston to define the nominal clearance between said force applying surface and said valve opening surface and wherein said lash take-up means includes second stop means for adjustably setting the maximum separation distance between said base support and said intermediate support, and wherein said intermediate support includes a stop surface for engaging said one portion of said actuating piston when said actuating piston is moved to place said force applying surface in said brake ready position whereby said second stop means may be adjusted to cause the distance between said retracted position and said brake ready position to be greater or less than said nominal clearance.

8. A braking system as defined in claim 7, wherein said actuating piston is generally cup-shaped with the rim thereof defining said force applying surface, said first and second spring and said intermediate support being positioned within said hollow interior of said actuating piston, said actuating piston containing a pair of diametrically opposed longitudinal slots extending from said rim toward said one portion, said base support including an elongated member which extends transversely through said longitudinal slots and which is fixedly retained at both its ends to said housing.

9. A braking system as defined in claim 8, wherein said braking mode operating means further includes (1) fluid control means for charging said fluid cavity with fluid at a pressure which is sufficient to overcome said first predetermined biasing force on said actuating piston to move said force applying surface from said retracted position to said brake ready position but which is insufficient to overcome said second predetermined biasing force.

10. A braking system as defined in claim 9, wherein said braking mode operating means further includes pressurizing means for cyclically increasing the pressure of fluid within said fluid cavity to a level which is sufficient to overcome periodically said second predetermined biasing force on said actuating piston to cause said force applying surface to move reciprocally between said brake ready position and said brake actuated position.

11. A braking system as defined in claim 10 for use on an internal combustion engine having a fuel injector train mechanically actuated near the end of each gas compressing stroke of the combustion engine cylinder, wherein said pressurizing means is mechanically actuated by the fuel injector train whenever the engine is operated in the braking mode.

* * * * *